US006001421A

United States Patent [19]

Ahonen et al.

[11] Patent Number: 6,001,421

[45] Date of Patent: Dec. 14, 1999

[54] METHOD FOR DRYING PAPER AND A DRY END OF A PAPER MACHINE

[75] Inventors: Pasi Ahonen, Jyväskylä; Jaakko Kallioniemi, Muurame; Juha Kaihovirta, Jyväskylä; Ville Korhonen, Jyväskylä; Matti Luontama, Jyväskylä, all of Finland

[73] Assignee: Valmet Corporation, Helsinki, Finland

[21] Appl. No.: 08/984,141

[22] Filed: Dec. 3, 1997

Related U.S. Application Data

[60] Provisional application No. 60/032,405, Dec. 4, 1996.

[30] Foreign Application Priority Data

Dec. 3, 1996 [FI] Finland ..... 964830

[51] Int. Cl.[6] ..... B05D 3/02

[52] U.S. Cl. ..... 427/316; 34/446; 34/117; 427/211; 427/366; 427/374.1; 427/377

[58] Field of Search ..... 34/444, 445, 446, 34/454, 455, 456, 116, 117, 119, 122; 162/206, 207, 135, 136; 427/209, 210, 211, 316, 366, 374.1, 377

[56] References Cited

U.S. PATENT DOCUMENTS

| | | | |
|---|---|---|---|
| 4,441,263 | 4/1984 | Vedenpaa | 34/115 |
| 4,516,330 | 5/1985 | Eskelinen et al. | 34/23 |
| 4,625,430 | 12/1986 | Aula et al. | 34/13 |
| 4,905,380 | 3/1990 | Eskelinen et al. | 34/23 |
| 5,022,163 | 6/1991 | Ilvespaa et al. | 34/23 |
| 5,172,491 | 12/1992 | Ilvespaa et al. | 34/115 |
| 5,269,074 | 12/1993 | Sims et al. | 34/117 |
| 5,416,980 | 5/1995 | Ilvespaa | 34/117 |
| 5,465,505 | 11/1995 | Kerttula | 34/452 |
| 5,553,393 | 9/1996 | Korhonen et al. | 34/117 |
| 5,557,850 | 9/1996 | Kotitschke et al. | 34/455 |
| 5,586,397 | 12/1996 | Kertulla et al. | 34/114 |
| 5,756,156 | 5/1998 | Elijoki et al. | 427/317 |

FOREIGN PATENT DOCUMENTS

| | | | |
|---|---|---|---|
| 0655528 | 5/1995 | European Pat. Off. | D21F 5/04 |
| 0726353 | 8/1996 | European Pat. Off. | D21F 5/04 |
| 01900 | 6/1992 | Finland . | |
| 944610 | 10/1994 | Finland . | |
| 950434 | 8/1995 | Finland . | |
| 963024 | 5/1996 | Finland . | |
| 963734 | 5/1996 | Finland . | |
| 963735 | 5/1996 | Finland . | |
| 98387 | 8/1996 | Finland . | |
| 951746 | 10/1996 | Finland . | |
| 9530795 | 11/1995 | WIPO | D21H 25/06 |
| 9632534 | 10/1996 | WIPO . | |

*Primary Examiner*—Henry Bennett
*Assistant Examiner*—Steve Gravini
*Attorney, Agent, or Firm*—Steinberg & Raskin, P.C.

[57] ABSTRACT

A dry end of a paper machine and a method for drying paper in which a paper web to be dried is passed from a press section of the paper machine into a forward dryer section including only single-wire groups with normal single-wire draw. The web is dried from the side of its bottom face in the dryer groups in the forward dryer section. From the forward dryer section, the web is passed into a finishing section in which the web is coated/surface-sized by a coating/surface-sizing device and then dried in an after-dryer by passing through at least one dryer group that applies a normal single-wire draw. Thereafter, the web is calendered and passed to a reeling station. Curling of the web is controlled by the operation or construction of components and/or by assemblies and combinations formed out of these components provided in connection with the forward dryer section and/or the finishing section.

34 Claims, 9 Drawing Sheets

METHOD FOR DRYING PAPER AND A DRY END OF A PAPER MACHINE

This appln. claims the benefit of U.S. Provisional Appln. No. 60/032,045 filed Dec. 4, 1996.

FIELD OF THE INVENTION

The present invention relates to a method for drying paper comprising the following steps:

a) passing the paper web from a press section of a paper machine into and through a forward dryer section of the paper machine having only single-wire groups with normal single-wire draw, each of the normal single-wire draw dryer groups including drying cylinders arranged in a first row, reversing cylinders arranged in a second row below the first row, and a drying wire for carrying the web over the drying cylinders and the reversing cylinders, the paper web being dried in the forward dryer section from the side of its bottom face, i.e., through contact of the bottom face with the drying cylinders, and b) passing the web from the forward dryer section into and through a finishing section of the paper machine, the web being coated/surface-sized web in the finishing section by means of a coating/surface-sizing device, then dried in an after-dryer section situated after the coating/surface-sizing device in a running direction of the web, the after-dryer including at least one dryer group that applies a normal single-wire draw, the web thereafter being calendered in a calender and passed to a reeling station in which the paper web is reeled into a machine reel.

Further, the present invention relates to a dry end of a paper machine comprising a forward dryer section including at least one dryer group having drying cylinders, reversing cylinders and a wire for carrying a web over the drying cylinders and the reversing cylinders, and a finishing section including a coating/surface-sizing device for coating/surface-sizing the web, an after-dryer for drying the web after it has been coated or surface-sized, a calender for calendering the web after the after-dryer and a reeling station for reeling the web into a machine reel.

BACKGROUND OF THE INVENTION

As known in the prior art, in multi-cylinder dryers of paper machines, twin-wire draw and/or single-wire draw is/are employed. When employing twin-wire draw, a group of drying cylinders comprises two closed (endless) wires, fabrics or belts which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire . Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders or rolls are placed in a lower row below the upper row of drying cylinders, which rows are typically horizontal and parallel to one another. In the following, when the terms "normal (dryer) group" and "inverted (dryer) group" are used, what is meant is expressly groups with single-wire draw in multi-cylinder dryers, of the type mentioned above. In an inverted dryer group, the heated drying cylinders are placed in a lower row and the reversing cylinders or rolls are placed in an upper row above the lower row of drying cylinders.

It is known to those skilled in the art that if paper is dried one-sidedly, the result is a tendency of curling of the sheet. For example, when paper is dried by means of normal groups with single-wire draw from the side of its bottom face only, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

As known in the prior art, the tendency of curling of paper (or the tendency to curl) is already affected in connection with the web formation, in particular at the sheet formation stage (in, for example, the current assignee's former designated Sym-Former™) by means of the selection of the difference in speed between the slice jet and the wire, and by means of other running parameters. For example, in the case of copying paper, by means of unequalsidedness of drying in the after-dryer, a suitable initial curl form is regulated for the sheet in order that the curling of the paper after one-sided or double-sided copying could be optimized. In the case of copying paper, the reactivity of curling, i.e., the extent to which curling occurs per unit of change in moisture content, is affected to a greater extent by means of a multi-layer structure of the paper, which is produced in connection with the web formation in the wet end.

The most recent technology related to the present invention in high-speed paper machines is based on dryer sections in which there is single-wire draw over the major part of the length of the machine and, with a view toward controlling the tendency of curling of paper, in practice, an inverted group is also almost always used in order to make the drying sufficiently symmetric in the z-direction. However, it has been found that an inverted group has certain obvious, inherent drawbacks in view of the runnability and the overall efficiency of the machine and in view of the profitability of the paper machine investment. Thus, from the point of view of the runnability of the paper machine, a dryer section fully supported over its entire length and based on the use of only normal groups with single-wire draw, without using any inverted groups, would be a highly justified solution. People skilled in the art have, however, not had the courage to introduce this solution in operation, because it has been considered that it would result in solutions uncontrollable and unfavorable from the point of view of the tendency of curling of paper.

One particular problem in the prior art dryer section constructions that include one or more inverted dryer groups is the removal of broke in the event of web breaks, because inverted groups are not self-cleaning by the effect of gravity.

With respect to the prior art related to the present invention, reference is made to the current assignee's Finnish Patent No. 91,900 (corresponding to U.S. Pat. No. 5,416,980 incorporated by reference herein), in which a method is described in the dryer section of a paper machine in particular for reducing the tendency of curling of paper. In this method, the paper web is dried by means of drying cylinders against whose heated faces the paper web is pressed by means of a drying wire. In the dryer section, groups of drying cylinders are used in which twin-wire draw and/or single-wire draw is/are applied. In this method, it has been considered advantageous that in the dryer section, substantially across the entire width of the paper web, hot water steam is fed, by whose means the strains that arise or tend to arise in the fiber mesh in the paper web are relaxed by means of heat and moisture in, or substantially directly after, the area of formation of the strains.

With respect to additional prior art related to the present invention, reference is made further to the current assignee's Finnish Patent No. 93,876 (corresponding to U.S. Pat. No. 5,553,393 incorporated by reference herein) and to the current assignee's Finnish Patent Application Nos. 925942 (corresponding to U.S. Pat. No. 5,465,505 incorporated by reference herein), 935340 (corresponding to U.S. Pat. No. 5,586,397 incorporated by reference herein), 950434 (corresponding to U.S. patent application Ser. No. 08/467,780 incorporated by reference herein) and 951746, and to the current assignee's, as yet unpublished Finnish Patent Application Nos. 963024, 963734, and 963735.

The current assignee's Finnish Patent No. 93,876 describes a dryer section of a paper machine in which there are dryer groups provided with single-wire draw. In this dryer section, it has been considered advantageous that, in order to optimize the drying capacity calculated per unit of length of the dryer section in the machine direction, different ratios of the diameters of the drying cylinders to the diameters of the reversing rolls have been employed with the progress of the drying, i.e., in the running direction of the web, so that in the first group or groups in the initial end of the dryer section this ratio is higher than in the groups in the middle area of the dryer section, and in the group or groups in the final end of the dryer section, a diameter ratio higher than the ratio of the groups at the initial end of the dryer section is used.

The current assignee's Finnish Patent Application No. 935340 describes methods for drying a paper web and dryer sections for a paper web wherein, after the press section, the paper web is dried in a number of successive groups with single-wire draw. According to one exemplifying embodiment, the paper web is dried from the side of its bottom face over the entire length by means of contact drying cylinders, and the paper web is dried from the side of its top face on the draw or draws of the paper web free from the wire, and/or the paper web is dried from the side of its top face by applying a drying air flow through the drying wire to the top face of the paper web.

The current assignee's Finnish Patent Application No. 925942 describes a so-called inverted dryer group with single-wire draw for a multi-cylinder dryer of a paper machine in which a support wire is arranged to be in contact with the reversing cylinders over a substantially large sector, which wire is guided by its guide rolls arranged in gaps between the reversing cylinders and by other necessary rolls, and the web is pressed by means of the tension of the support wire on the sectors against the drying wire.

In the current assignee's Finnish Patent Application No. 951746, a dryer-section concept and a method for drying a paper/board web are described, wherein impingement blowing units or equivalent are arranged in connection with at least some of the drying cylinders. Through the impingement blowing units, a heated medium, preferably air or steam, is passed through the wire into connection with the web so as to produce a two-sided drying effect and to increase the drying capacity.

In the current assignee's Finnish Patent Application No. 963734, a method is described for drying a surface-treated paper web or equivalent in an after-dryer of a paper machine as well as a dryer section of a paper machine for applying the method. With a view toward compensating for a tendency of curling of the paper web, in the after-dryer, the paper web is dried in a dryer group/groups making use of a normal single-wire draw. In connection with or after the drying, the paper web is treated by means of at least one device in order to compensate for a tendency of curling of the paper web, which devices are, for example, a steam box, a blower unit, a moistening device, and/or a soft calender.

On the other hand, in the current assignee's Finnish Patent Application No. 963735, a method for drying a surface-treated paper web or equivalent in an after-dryer of a paper machine as well as an after-dryer of a paper machine for applying the method are described. In the after-dryer, the paper web is dried in at least one dryer group that makes use of single-wire draw, and at the same time, the paper web is dried by means of an impingement drying device arranged in connection with at least one cylinder or roll in that dryer group.

The current assignee's Finnish Patent Application No. 963024 describes a method for drying a paper to be surface-treated, in particular fine paper, in an after-dryer in a paper machine as well as an after-dryer in a paper machine for carrying out the method. After the surface-sizing or coating, the paper web is dried by means of an upwardly open inverted group with single-wire draw, in which connection the tendency of curling formed in the paper web in the forward dryer section can be substantially eliminated and/or compensated for.

OBJECTS AND SUMMARY OF THE INVENTION

Accordingly, it is an object of the present invention to provide a dry end of a paper machine in which inverted groups are not needed at all and not used, but which, however, meets all other commercial requirements that are imposed on the drying of a paper web.

Another object of the present invention is to approach the problems of drying a paper web from a new point of view and to suggest novel solutions for these problems, which solutions are somewhat contrary to conventional modes of thinking.

It is another object of the present invention to further develop the prior art constructions described above so that the curling of the paper can be controlled more efficiently in the dry end of the paper machine.

It is a further object of the present invention to provide a dry end of a paper machine with finishing devices in which the runnability of the web therethrough can be brought to a particularly high level.

Further, it is an additional object of the invention to provide a dry end of a paper machine with finishing devices in which unequalsidedness, roughness, glaze, etc., surface properties of the paper are controlled.

In view of achieving the objects stated above and others, the method in accordance with the invention comprises the steps of controlling curling of the paper web in the area of a forward dryer section of the paper machine and/or a finishing section of the paper machine arranged after the forward dryer section by means of specific curl-affecting components arranged in the forward dryer section and/or the finishing section and/or by designing the components of the forward dryer section and finishing section relative to one another in order to obtain a certain drying relationship which will affect the curl tendency of the web.

The dry end of a paper machine in accordance with the invention comprises curl control means which may be assorted curl-affecting components and/or assemblies and combinations formed out of such components arranged and operated in order to control curling of the paper web in the area of the forward dryer section and/or of the finishing section. Also, the curl control means may be an appropriate relative dimensioning of the cylinders in the forward dryer section and in an after-dryer of the finishing section of the paper machine.

In the arrangement in accordance with the invention, the forward dryer section in the dry end of the paper machine is exclusively based on dryer groups with single-wire draw, i.e., includes only normal single-wire draw dryer groups, in which case, the removal of broke takes place all the time by the force of gravity and does, thus, not cause problems. Likewise, in the single-wire draw in the forward dryer section, the paper web is constantly supported by a wire, whereby the runnability is improved and it is possible to increase the running speed of the web through the dryer section.

With a view toward controlling the unequalsidedness of paper and in particular the curling arising from one-sided drying, in the forward dryer section and/or in the after-dryer in the dry end of the paper machine, curl-affecting components or elements are arranged for the control of the tendency of curling of the web so that a desired curl form is obtained for the paper. For the purpose of controlling the curling, various elements are used, such as steam boxes, impingement blow units, dryer groups with twin-wire draw, a separate lower support fabric, a predetermined ratio of drying cylinders to reversing cylinders, etc., arranged in a suitable way in the area of the entire dry end and as different combinations. Thus, in the present invention it has been realized to control the curling in a number of different ways in the dry end of the paper machine.

According to an exemplifying embodiment of the invention, both the forward dryer section and the after-dryer are constructed exclusively of dryer groups with normal single-wire draw. In the forward dryer section, blowing through the wire is employed for regulating the curling; from locations above one or more cylinders, hot air is blown out of impingement blow devices arranged in opposed relationship to at least one of the cylinders, and evaporation takes place through the wire and affects the drying and, thus, the curling of the paper. On the other hand, in the after dryer, for example, steam boxes and possibly blowings of moist air taken from the forward dryer section are employed for controlling the curling of the web.

In a second exemplifying embodiment of the invention in which both the forward dryer section and the after-dryer are constructed exclusively of dryer groups with normal single-wire draw, an essential feature is that, where applicable, with a view toward increasing the capacity and compensating for the curling of the web, impingement blow devices or equipment is added in connection with the drying cylinders in the dryer groups, and with a view toward controlling the curling, a lower support belt may also be added to a dryer group. The lower support belt circulates against the lower faces of the reversing rolls while guided by its own guide rolls, and is so impermeable that it prevents evaporation of water out of the web from its lower face, whereby the tendency of curling can be controlled.

According to a further exemplifying embodiment of the invention, the forward dryer section is constructed exclusively of dryer groups with single-wire draw, to which groups, where applicable, impingement blow devices or equipment are added for regulation of the curling and, if necessary, also in order to increase the drying capacity. The after-dryer has been constructed so that it includes both dryer groups with single-wire draw and those with twin-wire draw, the curling being controlled by means of the dryer groups with twin-wire draw. According to a modification of this embodiment, impingement blow equipment can also be added to the groups with single-wire draw in the after-dryer.

According to an exemplifying embodiment of the invention, in which the forward dryer section is exclusively comprised of dryer groups with single-wire draw, as is the after-dryer, in the after-dryer, in order to control the curling, a higher ratio of the diameter of a drying cylinder to the diameter of a reversing roll is used than in the forward dryer section, in which case a more equal evaporation is obtained from the top side and from the bottom side. Moreover, if necessary, in the dryer group it is possible to use airborne type hoods arranged in connection with the reversing cylinders in order to increase the capacity and/or to compensate for the curling, both in the after-dryer and in the forward dryer.

According to a further exemplifying embodiment of the invention, in which the forward dryer section comprises dryer groups with single-wire draw, as is the after-dryer, in the after-dryer, with a view toward controlling the curling, steam boxes are arranged by whose means steam with a content of energy is blown against the web in the area of the reversing cylinders. With a view toward intensifying the condensation, one or several drying cylinders can also be cylinders with adjustable temperature, i.e., cooling/heating cylinders. Between the dryer section and a calender, there can also be an additional steam box in order to control the curling. Instead of a steam box, it is also possible to use moist air or any other, equivalent medium, such as a device that blows moist air that is brought from the forward dryer, or, for example, a separate water atomizing box, by whose means water is sprayed by means of air as small drops toward the web, or an airborne type hood to be placed underneath. Further, in the after-dryer, it is possible to arrange a so-called "spreader bar" at one side or both sides of the paper web which engages with the web in order to work the curling of the paper web mechanically. In this manner, in particular the curling of the web in the longitudinal direction is affected. The spreader bar can also be of a spreader roll type, in which case the effect on cross-direction curling can be enhanced.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
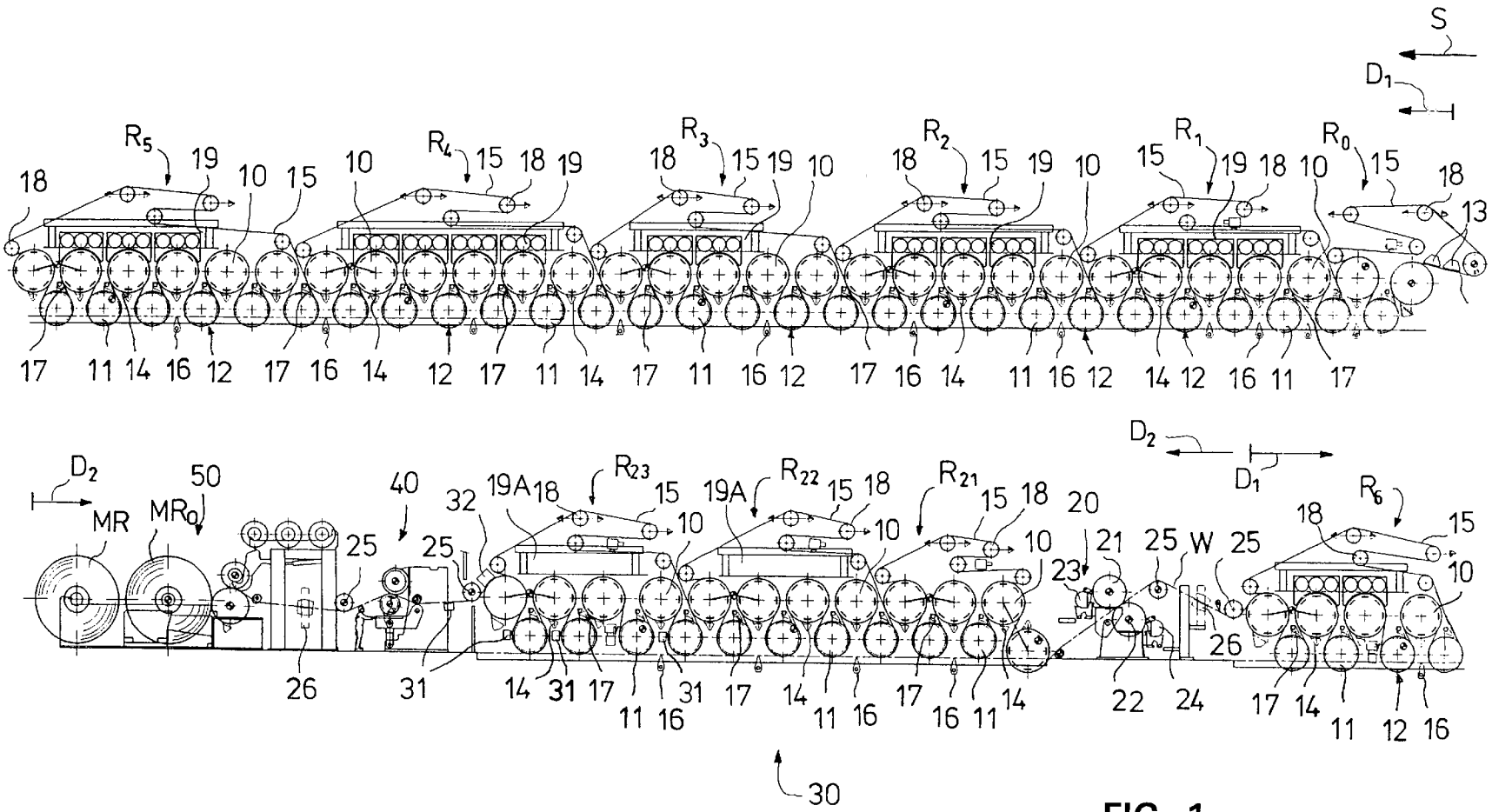
FIGS. 1–4 are schematic illustrations of different exemplifying embodiments of the invention in the dry end of a paper machine in which the dry end of the paper machine is shown from the forward dryer up to the machine reel-up.

Referring to FIGS. 1–6E wherein like reference numerals refer to the same or similar elements, as shown in FIGS. 1–4, 6D and 6E, a paper web W is brought into a forward dryer section $D_1$ from a press section of the paper machine onto a drying wire 15 of a first group $R_0$ with single-wire draw. The web W is attached to the wire 15 by the effect of a vacuum present in suction boxes 13 arranged in a loop of the wire 15. The forward dryer section $D_1$ includes 7 groups $R_0, \ldots, R_6$ with single-wire draw, and the web W has closed draws through the group gaps between these groups. The machine direction, i.e., the direction of progress of the web W, is denoted by arrow S. In the forward dryer section $D_1$ in accordance with the invention, all the groups $R_0, \ldots, R_N$ with single-wire draw are so-called normal groups, in which the drying cylinders 10, e.g., steam-heated smooth-faced drying cylinders, are arranged in an upper substantially horizontal row and reversing suction cylinders 11 are arranged in a lower substantially horizontal row. The number of the dryer groups is generally from 4 to 12, and preferably N is from 6 to 8.

Each normal group $R_0, \ldots, R_N$ has a drying wire 15 of its own which is guided by a respective set of guide rolls 18. The drying wires 15 press the web W to be dried on the drying cylinders 10 against the smooth heated faces of the drying cylinders 10, and on the reversing cylinders 11, the web W remains at the side of the outside curve on the outside face of the wire 15. On the reversing cylinders 11, the web W is kept reliably on the support of the wire 15 against the effect of centrifugal forces by the effect of a vacuum (negative pressure) present on grooved faces 12 of the reversing cylinders 11 or on the perforated mantle of an equivalent suction roll, whereby cross-direction shrinkage of the web W is also counteracted. As reversing suction cylinders 11, suction cylinders marketed by the current assignee with the trade mark "VAC-ROLL"™ are preferably used, which suction cylinders do not include an inside suction box. With respect to the details of the constructions of such suction cylinders, reference is made to the current assignee's Finnish Patent No. 83,680 (corresponding to U.S. Pat. Nos. 5,022,163 and 5,172,491 incorporated by reference herein).

In the forward dryer section $D_1$ in accordance with a preferred embodiment of the invention, the support contact between the web W and the drying wire 15 is kept adequate also on the straight draws between the drying cylinders 10 and the reversing cylinders 11, at least on the runs from the drying cylinders 10 to the reversing cylinders 11, by arranging blow-suction boxes 17 along these straight draws. By means of the blow-suction boxes 17, the formation of pressures induced by the wire 15 is also prevented in the closing wedge-shaped nip spaces between the wire 15 and the mantles of the reversing cylinders 11. For the purposes herein, blow-suction boxes 17 are understood to designate blow boxes for blowing a medium such as air, whereby the air blowing produces a vacuum, and such blow boxes do not necessarily communicate with sources of negative pressure. With respect to details of the constructions of suitable blow-suction boxes 17, which are marketed by the current assignee with the trade mark "UNO RUN BLOW BOX"™, reference is made to the current assignee's Finnish Patent Nos. 59,637, 65,460 and 80,491 (corresponding to U.S. Pat. Nos. 4,441,263, 4,516,330 and 4,905,380, respectively, incorporated by reference herein). Blow-box constructions of other types, in themselves known, are also included in the scope of the overall concept of the present invention.

In the forward dryer section $D_1$, in the groups $R_0, \ldots, R_N$ with single-wire draw, blow boxes 16 are also employed in the gaps between adjacent reversing cylinders 11. By means of the blow boxes 16, gap spaces between the reversing cylinders 11 are air-conditioned and evaporation of water from the web W is promoted. The faces of the drying cylinders 10 are kept clean by doctors 14 or other suitable surface-cleaning means.

It is another substantial advantage of the forward dryer section $D_1$ used in the invention that in the groups $R_0, \ldots, R_N$ with single-wire draw, which extend over the entire length of the dryer section, removal of broke by the effect of gravity can be applied, for the single-wire groups $R_0, \ldots, R_N$ are open toward the bottom. In this manner, the paper web W that becomes broke can be removed without any special arrangements onto the broke conveyor (not shown) placed in the basement spaces of the paper machine and on this conveyor further into a pulper or pulpers.

With a view toward preventing cross-direction shrinkage of the web W, it is of particular importance that, in the forward dryer section $D_1$, the web W is kept in reliable contact with the drying wires 15 at all times. This holding effect is produced on the reversing cylinders 11 by means of a vacuum present in the grooved mantle 12 or equivalent of the reversing cylinders 11 and, on the straight runs between the cylinders 10 and the reversing cylinders 11, by means of pressure levels arranged by means of the blow-suction boxes 17 and partly also by means of the tension T of the web W in the machine direction, which tension produces a contact pressure $p_K = T/R$ (R=radius of the cylinders 11) between the web W and the wires 15.

As stated above, as the reversing cylinders 11 in the forward dryer $D_1$, favorably the current assignee's VAC-ROLL™ rolls are used. In these rolls, the vacuum effect is spread through the perforations on the reversing cylinders 11 onto the grooved mantle 12 so that the wedge-shaped nip spaces between the reversing cylinders 11 and the drying wire can also be evacuated efficiently. In this manner, pressures cannot be induced into these wedge spaces, which pressures would attempt to separate the web W from the drying wire when the web W is placed outside. In the alternative, if suction rolls provided with inside suction boxes and possibly a perforated mantle are used as the reversing cylinders 11 in the forward dryer section $D_1$, the suction zone should preferably be extended over an area wider than the turning sector of the drying wire 15 and the web, so that the suction effect and the free flow of air can be extended into the wedge spaces, for the purposes mentioned above.

Besides the forward dryer section $D_1$ described above, the dry end of a paper machine in accordance with the invention includes a finishing section or unit $D_2$ placed after the forward dryer $D_1$ in the machine direction. The finishing unit $D_2$ includes a machine reel-up 50, for example a Pope-type reel-up. A machine reel that is being produced on-line by means of the reel-up 50 is denoted by reference M, and one complete machine reel is denoted by reference MR. The web W is brought to the machine reel-up 50 through a calender 40 from an after-dryer 30, which is placed after a coating/surface-sizing device 20 in the finishing section $D_2$. The web is calendered in the calender 40 and coated or surface-sized in the coating/surface-sizing device 20. Thus, the finishing unit $D_2$ includes the coating/surface-sizing device 20, the after-dryer 30, the calendar 40 and the machine reel-up 50.

After the forward dryer section $D_1$, the paper web W, which has been dried to a dry solids content $k_2$ from about 96% to about 99%, is passed over paper guide rolls 25 and over a measurement beam 26 arranged between the guide rolls 25 into the coating/surface-sizing device 20. The measurement beam 26 measures the property profiles of the paper. Coating device 20 is, for example, a coating device marketed by the current assignee with the name Sym-Sizer™. The coating device 20 includes two coating rolls 21 and 22 arranged one opposite to the other, and size feed devices 23 and 24 arranged in connection with a respective one of the rolls so that the paper web W is coated from both sides in a coating nip NS defined between the rolls 21 and 22. Owing to the use of a water-containing coating agent, the web W is partly moistened in the coating nip NS from both sides. Then, the web W, which was dried in the forward dryer $D_1$ asymmetrically from the side of its bottom face W and which has a tendency of curling, is treated into such a state that its internal strains are partly relaxed or at least substantially reduced.

In the exemplifying embodiment shown in FIG. 1, the forward dryer section $D_1$ is exclusively comprised of dryer groups $R_0, \ldots, R_6$ with single-wire draw, in which the paper web W runs meandering from one drying cylinder 10 onto a reversing roll 11 and onto another drying cylinder 10 and so on. In the dryer groups $R_0, \ldots, R_6$ in connection with some of the drying cylinders 10 in the groups, upper impingement blow devices or equipment 19 are arranged in order to regulate the curling of the web. By means the impingement blow devices 19, hot air is blown toward the web W, and evaporation takes place through the wire 15 thus regulating the curling. Each impingement blow device 19 is arranged in opposed relationship to one or more of the drying cylinders 10 and directs hot air or another heated medium at the web through the wire 15, i.e., the web runs between the face of the drying cylinders 10 and the wire 15.

The after-dryer 30 in the finishing section $D_2$ also comprises dryer groups $R_{21}, R_{22}, R_{23}$ with only single-wire draw, in connection with which groups, optionally impingement blow equipment 19A may be arranged for possible additional regulation of curling of the web. In the other respects, in the after-dryer 30, the curling is controlled by means of steam boxes 31 which apply steam, e.g., to the exposed face of the web as the web runs over the reversing cylinders 11. With a view toward achieving uniform drying, in connection with the last drying cylinder 10 in the last group $R_{23}$, an infra dryer 32 is arranged. Further, for regulation of curling, one steam box 31 is arranged before the web W is passed to the calender 40.

By means of the impingement blow device 19, blowing takes place through the wire 15, whereby it is possible to affect the regulation of curling when hot air or steam is blown since evaporation takes place through the wire 15. Impingement drying can be used in the forward dryer section $D_1$ also for requirements of additional drying capacity, for example for increasing the web running speed and for two-sided drying. The blowings from the impingement blow devices 19 also affect the regulation of curling so that ventilation is provided in the web area, in which case the evaporation is less one-sided. When such an arrangement is used, the wire 15 must be as open as possible since the hot air from the impingement blow devices 19 passes therethrough, and when the web runs, for example, at a speed of 25 meters per second, the blow velocity of the blow air should be from about 25 to about 150 meters per second, optimally about 100 meters per second. The blow angle of the nozzles of the impingement blow devices 19 is selected optimally based on the wire properties that are used, on the running speed of the machine, and on other parameters. The blow air can be outdoor air or heated air, up to about 400° C., preferably at a temperature from about 70° C. to about 200° C. The blow air may also be drawn from the forward drying section.

Figure 2:
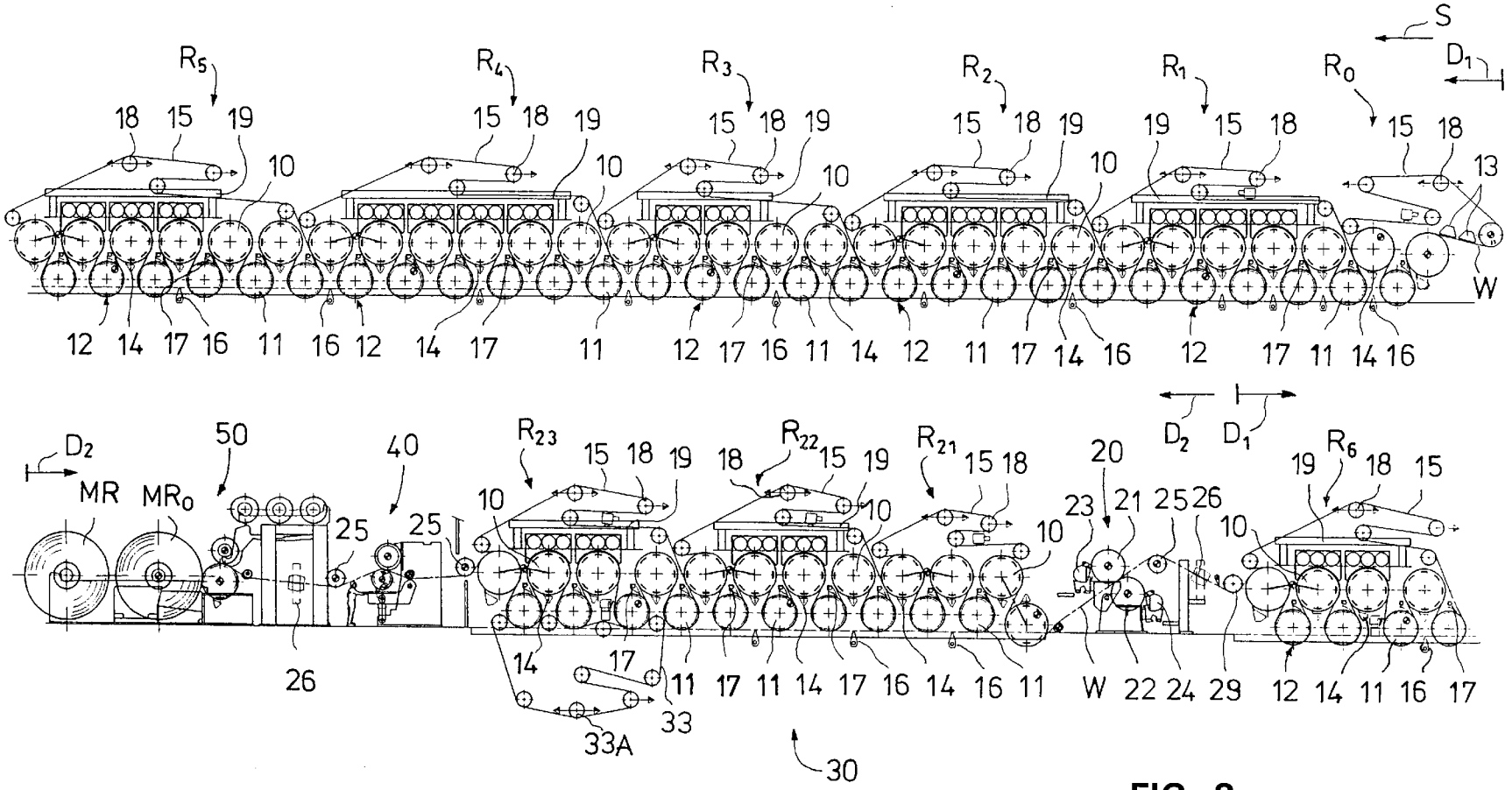

In the exemplifying embodiment shown in FIG. 2, the forward dryer section $D_1$ is similar to that shown in FIG. 1, however, the after-dryer 30 is also provided with impingement blow devices 19. Each impingement blow device 19 is arranged in opposed relationship to one or more of the drying cylinders 10 and directs hot air or another heated medium at the web through the wire 15, i.e., the web runs between the face of the drying cylinders 10 and the wire 15. In connection with the last dryer group $R_{23}$ in the after-dryer 30, a lower support fabric, wire or belt 33 is arranged to directly contact the web about a sector of one or more of the reversing cylinders 11. By means of the belt 33, evaporation of water out of the bottom face of the web W is prevented, whereby the curling of the web is thereby regulated. The lower support belt 33 is a tight, substantially impermeable belt, which prevents removal of moisture through the bottom face, in which case the moisture is removed from the opposite side of the web W. Thus, since the belt 33 prevents evaporation from the bottom face, the web W is curled towards the bottom face. It is a further advantage of the support belt 33 that the web runs between the two belts or wires 33,15 over a sector of the reversing cylinders 11, in which case the web W is supported particularly well. When a support belt 33 is used, its guide rolls 33A are placed at a lower level, approximately at the same level as the bottom edges of the reversing cylinders 11, in which case the removal of broke is easy as the belt 33 operates as a broke conveyor at the same time. The support belt 33 is preferably provided with a drive of its own, in which case its tension can be regulated as required. The support belt 33 is preferably a dense wire, whose permeability is low, or a smooth-faced belt. The temperature of the belt 33 can be adjusted, it can be cooled and/or heated as required when the curling is controlled. In this connection, it is also favorably possible to introduce moist air into the area between the belt 33 and the reversing cylinders 11, whereby the process can be made more efficient.

Figure 3:
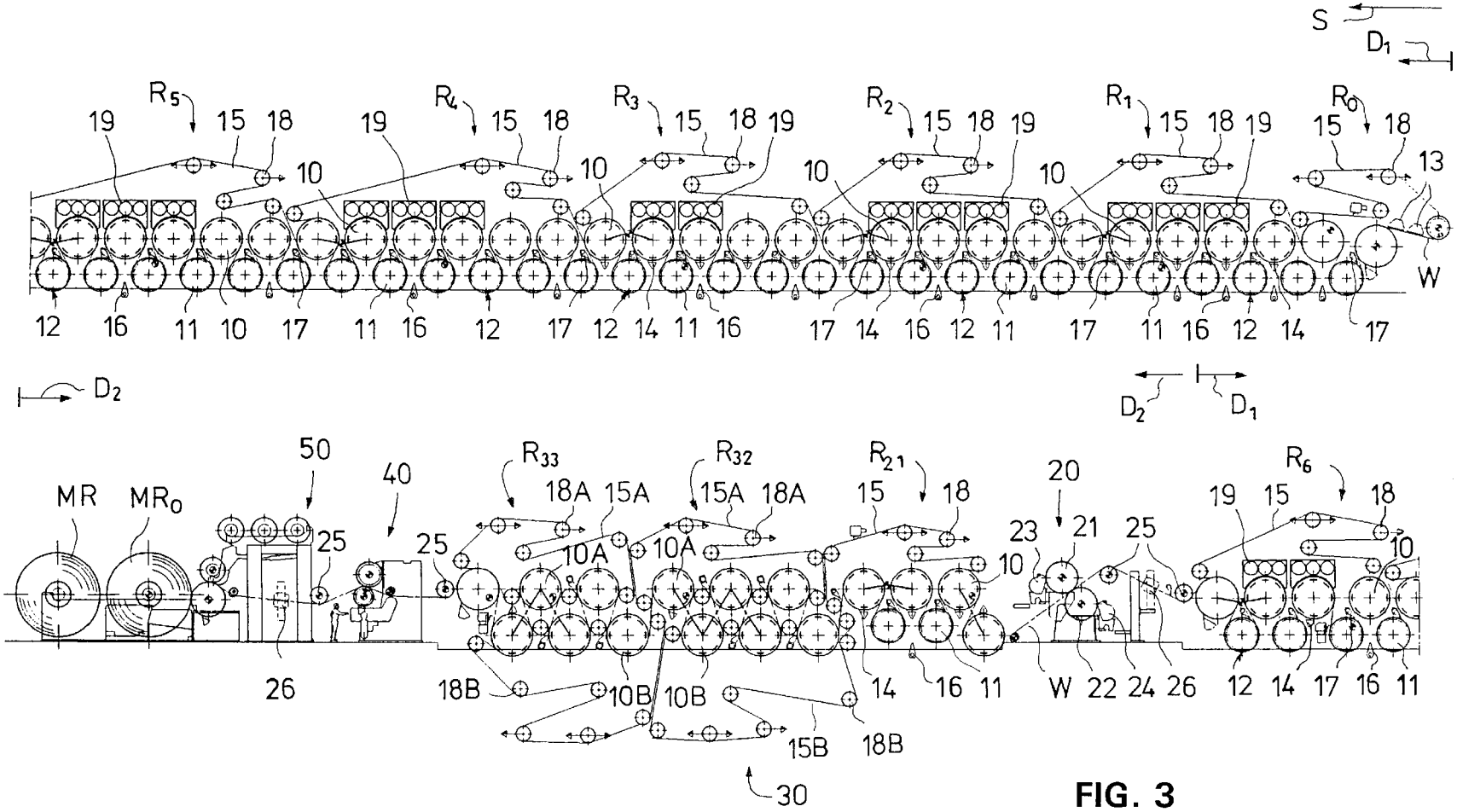

The forward dryer section $D_1$ in the exemplifying embodiment shown in FIG. 3 is similar to those shown in FIGS. 1 and 2, however, in this exemplifying embodiment, the last two dryer groups $R_{32}, R_{33}$ in the after-dryer 30 are formed as dryer groups with twin-wire draw, by means of which groups, the curling of the web is regulated. In the dryer groups $R_{32}, R_{33}$ with twin-wire draw, the dryer cylinders 10A, 10B are arranged in two substantially horizontal rows, and the cylinders in each row have a wire circulation 15A, 15B of their own guided by a respective set of guide rolls 18A, 18B. Between the rows, the web W has free unsupported draws. The bottom face of the web contacts the drying cylinders 10 in the upper row of the twin-wire draw dryer groups $R_{32}$,$R_{33}$ and the top face of the web contacts the drying cylinders 10 in the lower row of the twin-wire draw dryer groups $R_{32}$,$R_{33}$.

Also, in this exemplifying embodiment, impingement blow devices 19 are arranged in the forward dryer section in connection with the drying cylinders 10 in the upper row with a view toward regulating the curling, increasing the drying capacity, and providing two-sided drying. Each impingement blow device 19 is arranged in opposed relationship to one or more of the drying cylinders 10 and directs hot air or another heated medium at the web through the wire 15, i.e., the web runs between the face of the drying cylinders 10 and the wire 15.

Figure 4:
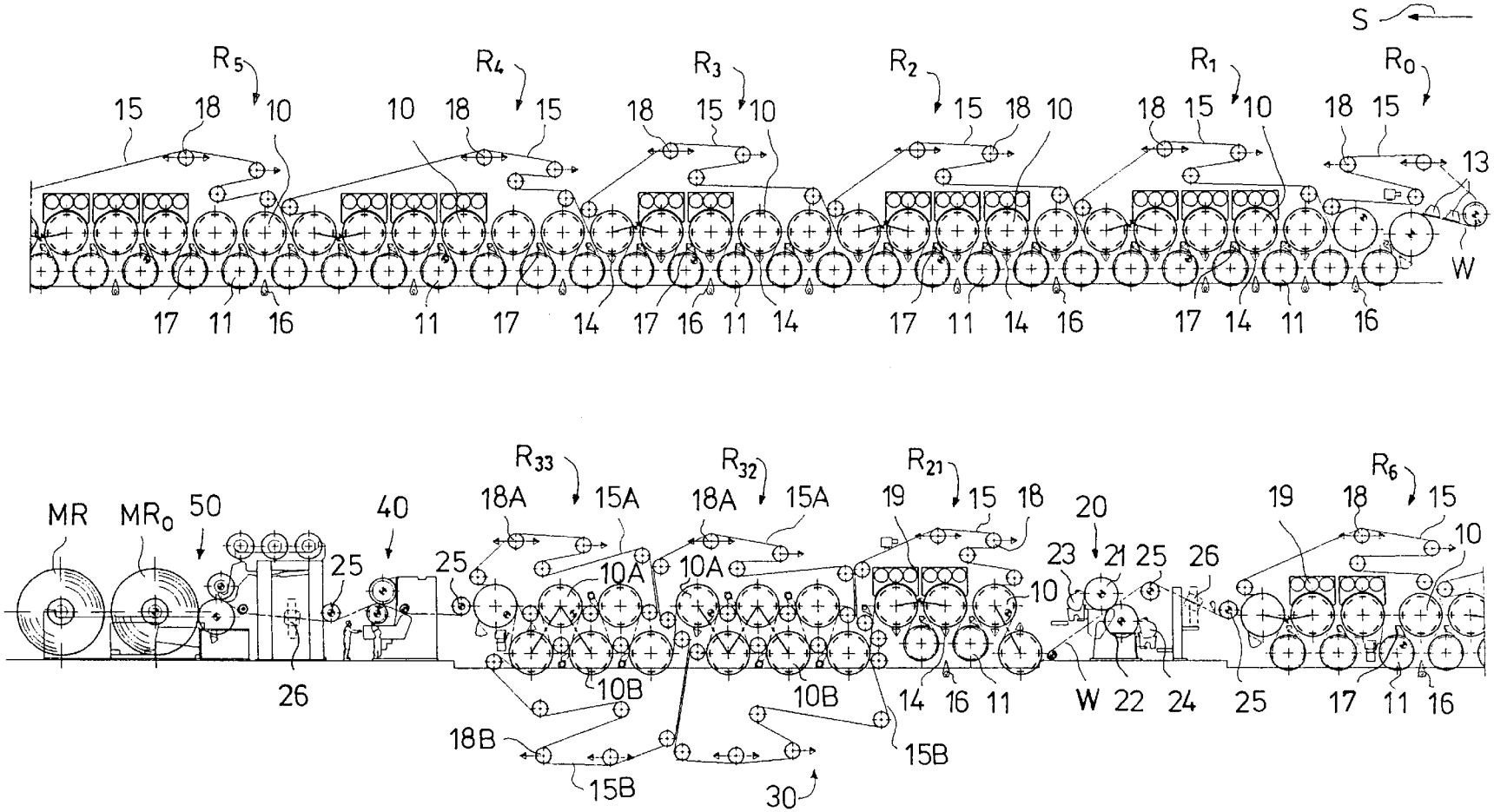

The exemplifying embodiment shown in FIG. 4 is similar to that shown in FIG. 3, however, in this embodiment, with a view toward controlling the curling of the web, impingement blow devices 19 are arranged additionally in connection with the first dryer group $R_{21}$ in the after-dryer. In this exemplifying embodiment, as is usual after a coating device 20, the steam temperature in the cylinders 10 is rather low, in which case the impingement blow devices 19 also provide additional capacity for heating the web W. It is a particular advantage of the impingement blow devices 19, of course in connection with all the embodiments described here, that their temperatures can be regulated quickly, in which case, for example, change of the machine from one paper grade to another is quicker, whereby additional production is achieved. Each impingement blow device 19 is arranged in opposed relationship to one or more of the drying cylinders 10 and directs hot air or another heated medium at the web through the wire 15, i.e., the web runs between the face of the drying cylinders 10 and the wire 15.

Figure 5:
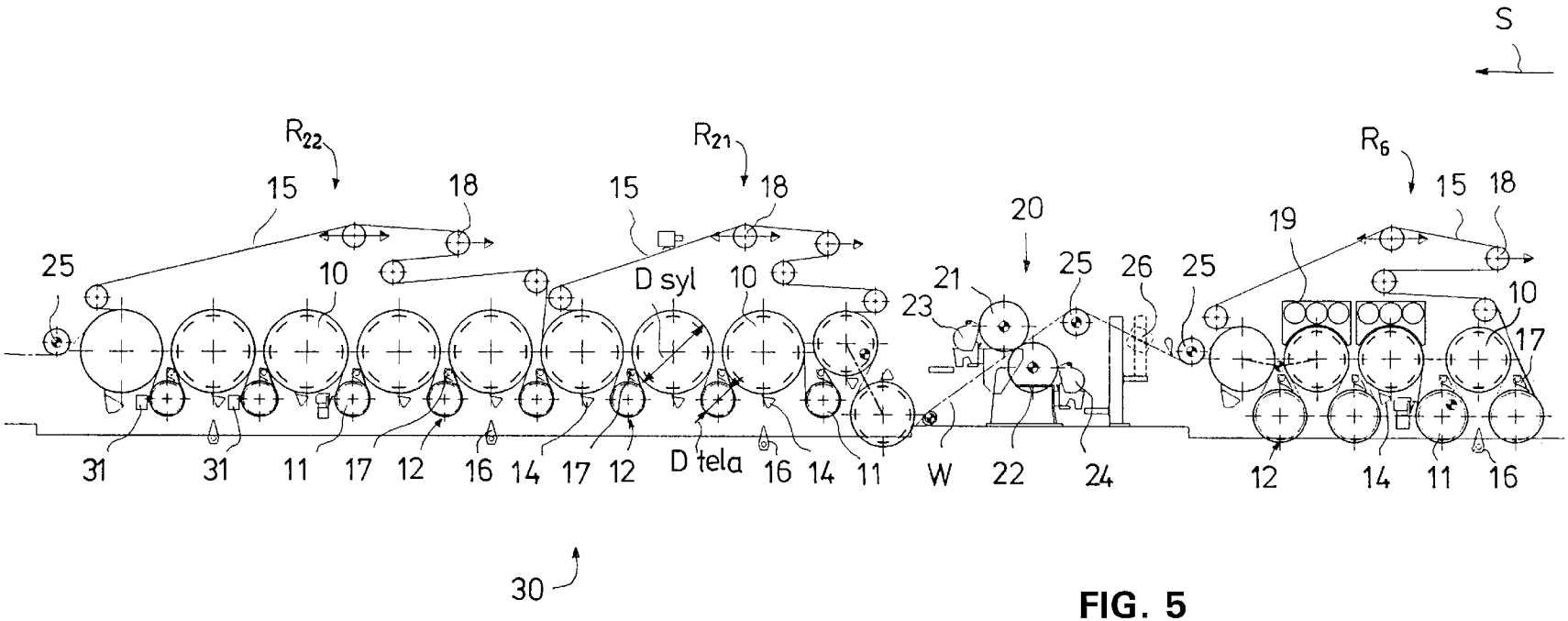
FIG. 5 is a schematic illustration of an exemplifying embodiment of the invention as an illustration in part of the after-dryer of a paper machine.

FIG. 5 shows an after-dryer 30 in which the curl of the web is controlled by providing a relative sizing of the drying cylinders and reversing cylinders or rolls in the after-dryer 30 and the forwarding drying section. Specifically, a larger ratio of the diameter of the drying cylinders to the diameter of reversing rolls (Dsyl/Dtela in FIG. 5) is employed in the after-dryer 30, compared with the forward dryer section $D_1$. In this case, a more uniform evaporation is provided at the top/bottom side of the web, and thereby the curling of the web can be controlled. The after-dryer 30 in the finishing section $D_2$ is comprised of two dryer groups $R_{21}$,$R_{22}$ with single-wire draw. In connection with the reversing rolls 11 in the latter group $R_{22}$ steam boxes 31 are arranged in order to control the curling. The exemplifying embodiment as shown in FIG. 5 can be arranged as an after-dryer 30 in connection with the forward dryers $D_1$ illustrated in FIGS. 1–4.

By means of this arrangement, the direction of evaporation is reversed, in which connection the web W has a longer passage to run on the drying cylinder 10, where the evaporation takes place primarily. The drying cylinders 10 have preferably adjustable steam pressures, and, if necessary, it is possible to use impingement blow devices 19 also in connection with these drying cylinders 10 in order to increase the capacity. At the side of the reversing cylinders 11, if necessary, it is possible to provide additional moisture, for example, by bringing moist air from the forward dryer section $D_1$, by using a water atomizing equipment, support belts, or equivalent arrangements that have been described above and will be described below.

Figure 6A:
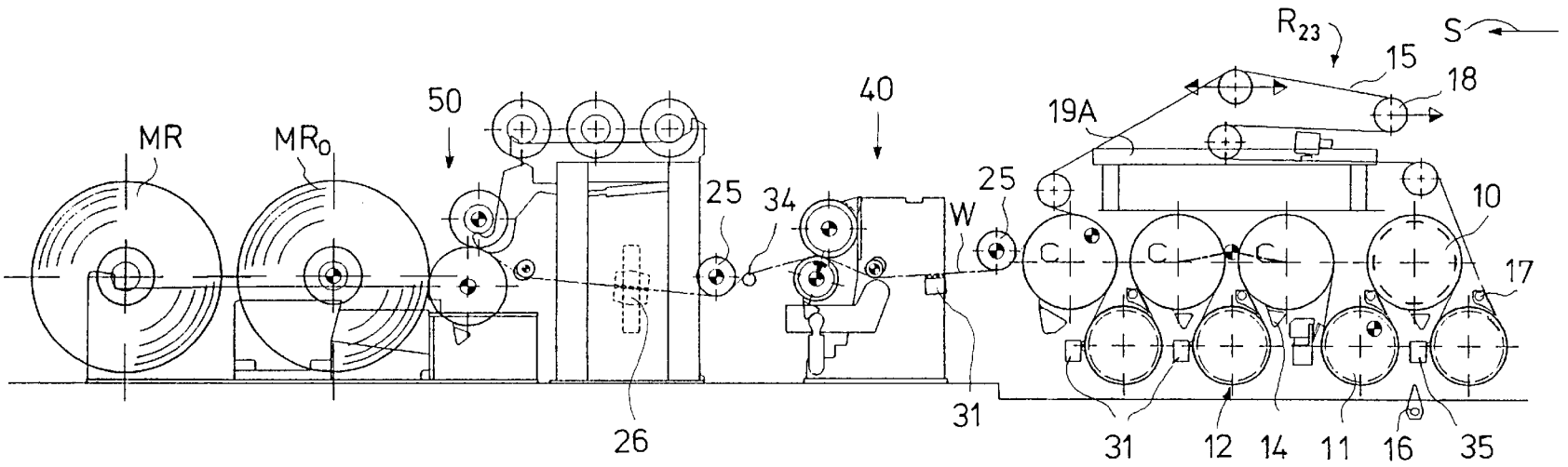
FIGS. 6A, 6B and 6C are schematic illustrations of exemplifying embodiments of the invention in which the last dryer group in the after-dryer and the machine reel-up are shown.

In the exemplifying embodiment shown in FIG. 6A, steam boxes 31 are arranged in connection with the last dryer group $R_{23}$ with single-wire draw in the after-dryer 30. By means of steam boxes 31, steam is blown onto the web W on the reversing cylinder 11, and in this manner the curling of the web is regulated. Further, a spray moistener 35 is provided, by whose means water is also sprayed onto the web W in order to regulate the curling. Of the drying cylinders 10, three cylinders are cylinders C with an adjustable operational temperature, so that they can be used as cooling or heating cylinders. Steam box 31 is arranged in opposed relationship to one of the reversing cylinders 11 and steam is directed therefrom with a content of energy onto the web as the web runs over the respective one of the reversing cylinders 11. Condensation of steam on the web may be intensified by adjusting the temperature of the cooling cylinder C arranged immediately after the reversing cylinder 11 to which the steam box 31 is in opposed relationship.

Figure 6B:
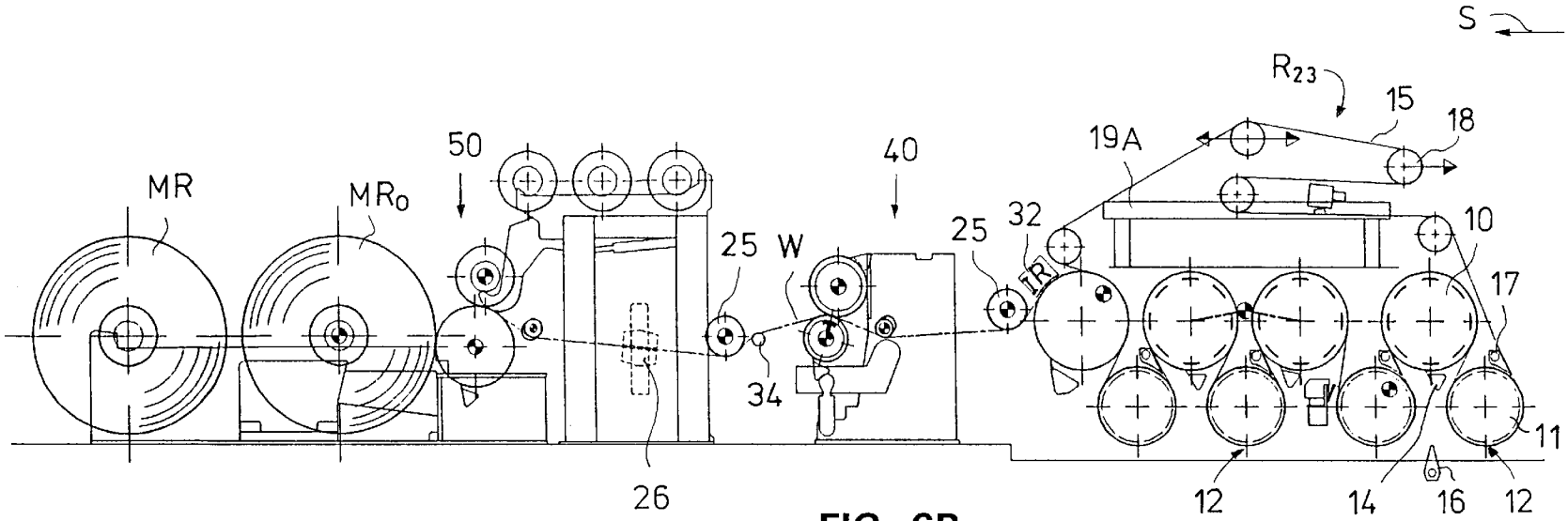

In the exemplifying embodiment shown in FIG. 6B, after the last dryer group $R_{23}$ in the after-dryer, an infra dryer 32 is arranged. By means of the infra dryer 32, the web W is dried intensively from the top side.

Figure 6C:
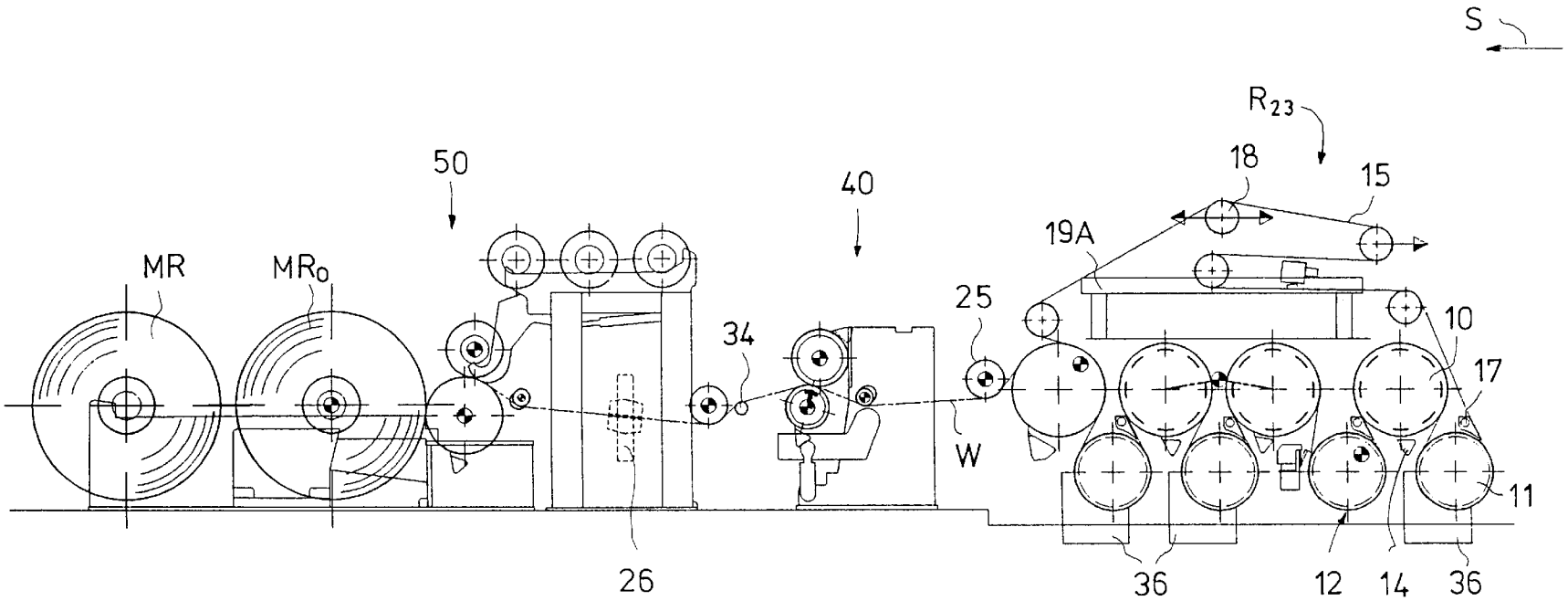

In FIGS. 6A–6C, a so-called spreader bar 34 is arranged in connection with the web and which engages the web, by means of which bar 34 the longitudinal curling of the web W is worked mechanically. The spreader bar 34 is a profiling roll, for example of the spreader roll type, in which case, in order to work the longitudinal curling, by its means it is also easy to act upon the cross-direction curling by means of mechanical working. A spreader bar 34 can be arranged at either side of the web or at both sides.

In the exemplifying embodiment shown in FIG. 6C, airborne type hoods 36 are arranged in connection with the last dryer group $R_{23}$ in the after-dryer 30 over one or more of the reversing cylinders 11. By means of the hoods 36, hot, moist air is blown toward the web W in order to control the curling.

Figure 6D:
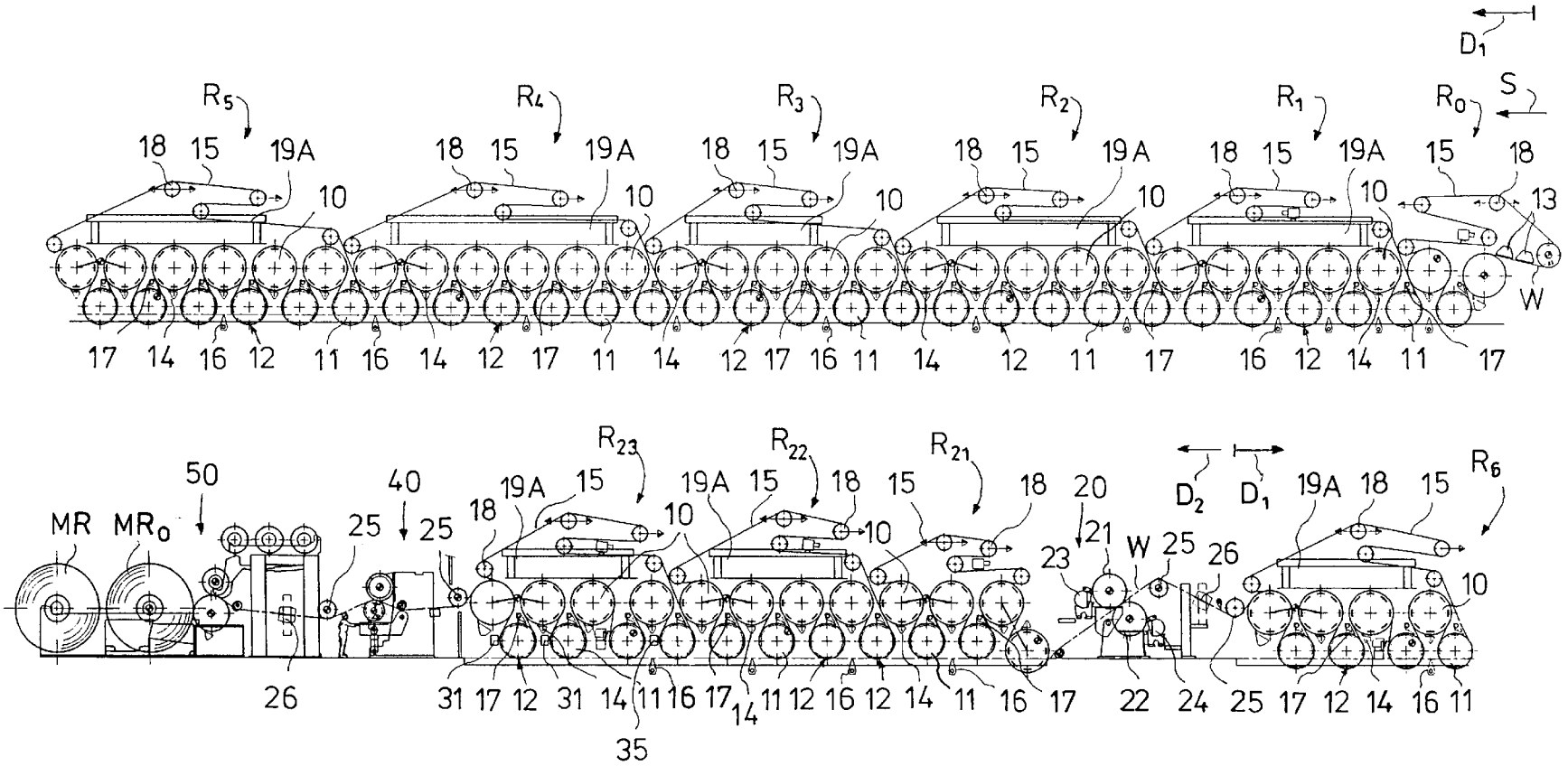
FIGS. 6D and 6E are schematic illustrations of exemplifying embodiments of the invention in which the entire dry end of a paper machine is shown from the forward dryer section to the machine reel-up.

The exemplifying embodiment shown in FIG. 6D comprises a forward dryer section D, with single-wire draw, in which options have been arranged for possible impingement blow devices 19A. In this exemplifying embodiment, regulation of curling of the web has been arranged by means of steam boxes 31 and a water spray device 35 arranged in connection with the last dryer group $R_{23}$ in the after-dryer 30. Also in the after-dryer, there are optional provisions for impingement blow equipment 19A.

Figure 6E:
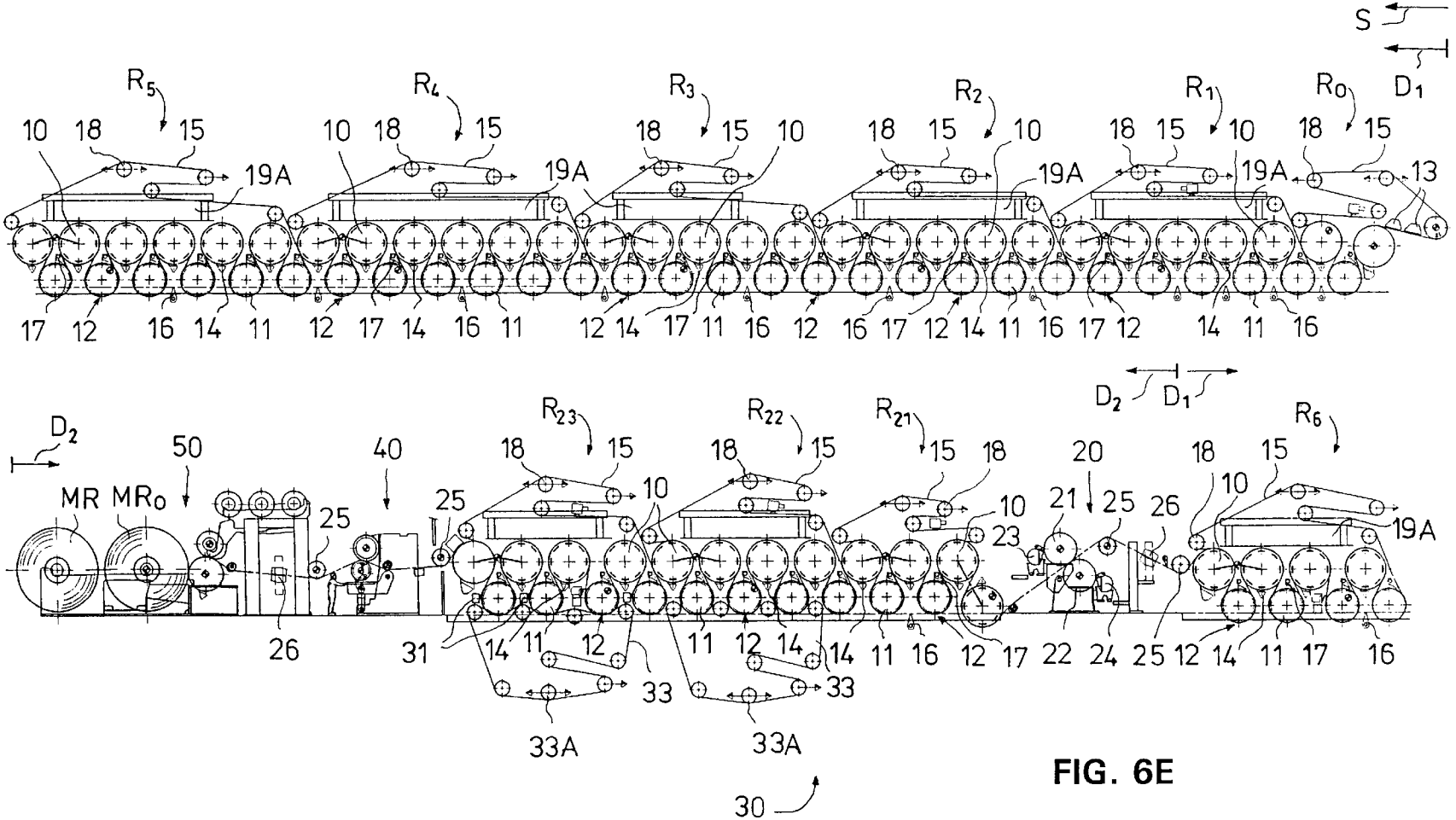

In the exemplifying embodiment shown in FIG. 6E, which is substantially similar to that shown in FIG. 6$D_1$ in view of regulation of curling of the web, the last two groups $R_{22}$,$R_{23}$ in the after-dryer 30 are provided with lower support belts 33, which prevent evaporation of water, and, moreover, in connection with the last dryer group, steam boxes 31 and a water spray device 35 are arranged. The lower supports belts 33 are described in detail above with reference to FIG. 2.

In the exemplifying embodiments shown in FIGS. 6A–6E, the emphasis is in particular on the control of curling before the calender 40 while the web W is cool. By means of a combination of steam boxes 31 and adjustable-temperature cylinders C, a particularly efficient combination is achieved because, the hotter the web W is, the less readily the steam is condensed, in which connection, when cooling cylinders are used, efficient condensation of the steam is obtained. With a view toward compensating for the tendency of curling, it is also important to be able to make the web W as dry as possible before steam treatment, to condense the steam, and to make the web W warm by the effect of the steam, in which case the water remains at one side of the web W and provides elimination of curling. In the control of curling, it is to be taken into account that the web W tends to be curled towards the side at which drying takes place last. As comes out from the exemplifying embodiments of the invention described above, the curling can be affected at different stages in different ways so as to obtain an optimal application.

The exemplifying embodiments illustrated in FIGS. 6A–6E are optimal when both the forward dryer section $D_1$ and the after-dryer 30 are constructed exclusively of dryer groups $R_0, \ldots, R_6, R_{21}, \ldots, R_{23}$ with single-wire draw and when the tendency of curling is controlled mainly by means of the last dryer group $R_{23}$ in the after-dryer 30. When a tendency of curling is compensated for, steam with a content of energy is blown out of the steam boxes 31, the superheating degree of this steam being preferably low in order that a condensation of maximal efficiency could be achieved. Thus, the temperature of the steam is typically from about 2° C. to about 10° C. above the dew point temperature. In such a case, a joint effect of moistening and thermal energy is achieved in the control of curling. The steam box 31 extends substantially across the entire width of the web, and it is, of course, arranged to be adjustable and profitable.

The web W can be moistened so that, in the final end of the dryer section, the face(s) of one or several drying cylinders is/are moistened, for example, by means of a water atomizing device arranged preferably in connection with a doctor 14, and the water fed out of the atomizer is vaporized and enters efficiently into contact with the web by the effect of the pressure caused by the wire. In the place of a cylinder, there can, of course, also be some other roll, in which case the water film applied to the face of the roll enters into contact with the web W when the wire presses the web against the roll.

Finnish Patent No. 70,275 (corresponding to U.S. Pat. No. 4,625,430 incorporated by reference herein) is related to the present invention and describes controlling the temperature of a drying wire so that the drying efficiency can be affected. Similarly, by means of the temperature of the drying wire it is possible to control the unequal-sidedness of drying. According to the present invention, in the after-dryer there are devices by whose means the temperature of the drying wire or wires and, thereby, the curling are affected. The wire can be heated, for example, by means of a steam box. For cooling, it is possible to use, for example, the methods and devices known from Finnish Patent No. 70,275.

The curling of the web can also be controlled by adjusting the humidity and temperature of the air blown through UNO-RUN™ blow boxes. Similarly, unequalsided evaporation and curling of the web can be affected by means of the humidity of the air in the hood surrounding the web from different sides. Thus, by regulating the state of the air blown out of ventilation boxes 16, possibly together with the air blown through the wire or with the air used in UNO-RUN™ boxes, it is possible to act upon the curling efficiently.

In U.S. Pat. No. 5,557,860, a steam box has been employed before the calender, after the forward dryer section exclusively provided with single-wire draw. If exclusively such an arrangement is used, there is a high risk that the surface properties of the final product are no longer as desired when the curling is under control. The scope of the present invention includes a combination in which the curling is controlled by means of blowing of steam or humid air before the calender, together with the control devices placed in the dryer section.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A method for drying a paper web after a press section of a paper machine, comprising the steps of:

passing the web from the press section into a forward dryer section including only normal single-wire draw dryer groups, each of said normal dryer groups including drying cylinders arranged in a first row, reversing cylinders arranged in a second row below said first row, and a drying wire for carrying the web over said drying cylinders and said reversing cylinders, drying the web in the forward dryer section by passing the web through said normal dryer groups such that a bottom face of the web contacts said drying cylinders, passing the web from the forward dryer section into a finishing section, coating/surface-sizing the web in the finishing section by means of a coating/surface-sizing device, drying the web in an after-dryer arranged in the finishing section after the coating/surface-sizing device and including at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, controlling curling of the web in the finishing section by arranging at least one steam box in the after-dryer in opposed relationship to a respective one of the reversing cylinders in said at least one normal single-wire draw dryer group in the after-dryer, directing steam from said at least one steam box toward the web as the web runs over the respective one of the reversing cylinders, and intensifying the condensation of the steam on the web by arranging a cooling cylinder having an adjustable operating temperature immediately adjacent the respective one of the reversing cylinders, calendering the web in a calender arranged after the after-dryer, and reeling the web into a machine reel.

2. The method of claim 1, further comprising the step of:

additionally controlling curling in the web in the forward dryer section.

3. The method of claim 1, wherein the step of controlling curling of the web further comprises the step of:

adjusting the temperature of the cooling cylinder.

4. The method of claim 1, wherein the step of controlling curling of the web further comprises the step of:

guiding a substantially impermeable support wire or belt into contact with the web as the web runs over at least one of said reversing cylinders in said at least one normal dryer group in the after-dryer such that evaporation of moisture from the web into the support wire or belt is prevented.

5. The method of claim 1, wherein the step of controlling curling of the web comprises the step of:

arranging two twin-wire draw dryer groups after said at least one normal dryer group in the after-dryer, each of said twin-wire draw dryer groups including first and second rows of drying cylinders, a first drying wire for carrying the web over said first row of drying cylinders such that the bottom face of the web contacts said drying cylinders in said first row and a second drying wire for carrying the web over said second row of drying cylinders such that a top face of the web contacts said drying cylinders in said upper row.

6. The method of claim 1, wherein the step of controlling curling of the web further comprises the step of:

arranging at least one impingement blow device in the after-dryer, each above at least one of said drying cylinders in said at least one normal dryer group in the after-dryer, and directing hot, moist air from said at least one impingement blow device toward the web.

7. The method of claim 2, wherein the step of controlling curling of the web comprises the step of:

selecting the diameter of said drying cylinders and said reversing cylinder in said at least one normal dryer group in the after-dryer and the diameter of said drying cylinders and said reversing cylinders in said normal dryer groups in the forward dryer section such that the ratio of the diameter of said drying cylinders to the diameter of said reversing cylinders in said at least one normal dryer group in the after-dryer is greater than the ratio of the diameter of said drying cylinders to the diameter of said reversing cylinders in said normal dryer groups in the forward dryer section.

8. The method of claim 1, wherein the step of controlling curling of the web further comprises the step of:

spraying water mist onto an exposed face of the web in the after-dryer.

9. The method of claim 1, wherein the step of controlling curling of the web further comprises the step of:

heating the web by means of an infra dryer before the web is passed into the calender.

10. The method of claim 1, wherein the step of controlling curling of the web comprises the steps of:

arranging at least one hood in connection with said at least one normal dryer group in the after-dryer, and blowing moist air through said at least one hood toward the web.

11. The method of claim 1, wherein the step of controlling curling of the web further comprises the step of:

arranging a spreader bar to contact at least one face of the web and work the web mechanically.

12. The method of claim 1, wherein the after-dryer comprises only a plurality of normal dryer groups.

13. The method of claim 1, further comprising the step of:

measuring the curl of the web after the calender, the curling of the web being controlled in the at least one of the forward dryer section and the finishing section based on the measured curl of the web after the calender.

14. A dry end of a paper machine, comprising a forward dryer section including at least one dryer group, each of said at least one dryer group comprising drying cylinders, reversing cylinders and at least one drying wire for guiding a web over said drying cylinders and said reversing cylinders, a finishing section arranged after said forward dryer section, said finishing section including a coating/surface-sizing device for coating/surface-sizing the web, an after-dryer arranged after said coating/surface-sizing device for drying the web after the web is coated/surface-sized, a calender arranged after said after-dryer for calendering the web and a reeling station arranged after said calender for reeling the web into a machine reel, said after-dryer comprising at least one cooling cylinder having an adjustable operating temperature, and curling control means arranged in or incorporated into said finishing section for controlling the curling of the web, said curling control means comprising means for applying steam to the web arranged adjacent said at least one cooling cylinder.

15. The dry end of claim 14, wherein said after-dryer comprises at least one dryer group, each of said at least one dryer group including drying cylinders, reversing cylinders and at least one wire for guiding the web over said drying cylinders and said reversing cylinders, said curling control means further comprising an impingement blow device arranged above at least one of said drying cylinders in said at least one dryer group in said after-dryer.

16. The dry end of claim 14, wherein said after-dryer comprises at least one normal single-wire draw dryer group including drying cylinders arranged in a first row, reversing cylinders arranged in a second row below said first row, and a drying wire for carrying the web over said drying cylinders and said reversing cylinders, said curling control means comprising at least one steam box arranged in said after-dryer in connection with said at least one normal single-wire draw dryer group for blowing steam toward an exposed face of the web.

17. The dry end of claim 14, wherein said after-dryer comprises at least one dryer group, each of said at least one dryer group including drying cylinders, reversing cylinders and a wire for guiding the web over said drying cylinders and said reversing cylinders, said curling control means further comprising at least one support wire or belt arranged in said at least one dryer group of said after-dryer to contact the web as the web runs over at least one of said reversing cylinders.

18. The dry end of claim 14, wherein said after-dryer comprises two twin-wire draw dryer groups, each of said twin-wire draw dryer groups including first and second rows of drying cylinders, a first drying wire for carrying the web over said first row of drying cylinders such that the bottom face of the web contacts said drying cylinders in said first row and a second drying wire for carrying the web over said second row of drying cylinders such that a top face of the web contacts said drying cylinders in said upper row.

19. The dry end of claim 14, wherein said after-dryer comprises at least one dryer group, each of said at least one dryer group including drying cylinders, reversing cylinders and at least one wire for guiding the web over said drying cylinders and said reversing cylinders, further comprising additional curling control means incorporated into said after-dryer and said forward dryer section and comprising the diameter of said drying cylinders and said reversing cylinders in said at least one dryer group in said after-dryer and said at least one dryer group in said forward dryer section being such that the ratio of the diameter of said drying cylinders to the diameter of said reversing cylinders in said at least one dryer group in said after-dryer is greater than the ratio of the diameter of said drying cylinders to the diameter of said reversing cylinders in said at least one dryer group in said forward dryer section.

20. The dry end of claim 14, wherein said means for applying steam to the web comprise at least one water atomizing device structured and arranged to spray water mist onto the web.

21. The dry end of claim 14, wherein said curling control means further comprise an infra dryer arranged in said after-dryer before said calender.

22. The dry end of claim 14, wherein said after-dryer comprises at least one dryer group including drying cylinders, reversing cylinders and a wire for guiding the web over said drying cylinders and said reversing cylinders, said curling control means further comprising at least one hood arranged in connection with said at least one dryer group in said after-dryer, said at least one hood including means for blowing moist air toward the web.

23. The dry end of claim 14, wherein said curling control means further comprise a spreader bar arranged to contact at least one face of the web and work the web mechanically.

24. The dry end of claim 14, wherein said after-dryer comprises only normal single-wire draw dryer groups, each of said normal single-wire draw dryer groups including drying cylinders arranged in a first row, reversing cylinders arranged in a second row below said first row, and a drying wire for carrying the web over said drying cylinders and said reversing cylinders.

25. The dry end of claim 14, further comprising measurement means arranged after said calender for measuring the curl of the web, said curling control means being controlled based on the measured curl of the web by said measurement means.

26. The dry end of claim 14, further comprising additional curling control means arranged in or incorporated into said forward dryer section for additionally controlling the curling of the web.

27. The method of claim 2, wherein the step of controlling curling of the web comprises the steps of:

arranging at least one impingement blow device in the forward dryer section, each above at least one of said drying cylinders in one of said normal dryer groups, and directing hot, moist air from said at least one impingement blow device toward the web.

28. The dry end of claim 26, wherein said additional curling control means comprise an impingement blow device arranged above at least one of said drying cylinders in said at least one dryer group in said forward dryer section.

29. A method for drying a paper web after a press section of a paper machine, comprising the steps of:

passing the web from the press section into a forward dryer section including only normal single-wire draw dryer groups, each of said normal dryer groups including drying cylinders arranged in a first row, reversing cylinders arranged in a second row below said first row, and a drying wire for carrying the web over said drying cylinders and said reversing cylinders, drying the web in the forward dryer section by passing the web through said normal dryer groups such that a bottom face of the web contacts said drying cylinders, passing the web from the forward dryer section into a finishing section, coating/surface-sizing the web in the finishing section by means of a coating/surface-sizing device, drying the web in an after-dryer arranged in the finishing section after the coating/surface-sizing device and including at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, controlling curling of the web in the finishing section by arranging two twin-wire draw dryer groups after said at least one normal dryer group in the after-dryer, each of said twin-wire draw dryer groups including first and second rows of drying cylinders, a first drying wire for carrying the web over said first row of drying cylinders such that the bottom face of the web contacts said drying cylinders in said first row and a second drying wire for carrying the web over said second row of drying cylinders such that a top face of the web contacts said drying cylinders in said upper row, calendering the web in a calender arranged after the after-dryer, and reeling the web into a machine reel.

30. A method for drying a paper web after a press section of a paper machine, comprising the steps of:

passing the web from the press section into a forward dryer section including only normal single-wire draw dryer groups, each of said normal dryer groups including drying cylinders arranged in a first row, reversing cylinders arranged in a second row below said first row, and a drying wire for carrying the web over said drying cylinders and said reversing cylinders, drying the web in the forward dryer section by passing the web through said normal dryer groups such that a bottom face of the web contacts said drying cylinders, passing the web from the forward dryer section into a finishing section, coating/surface-sizing the web in the finishing section by means of a coating/surface-sizing device, drying the web in an after-dryer arranged in the finishing section after the coating/surface-sizing device and including at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, controlling curling of the web in the finishing section by arranging at least one hood in connection with said at least one normal dryer group in the after-dryer, and blowing moist air through said at least one hood toward the web, calendering the web in a calender arranged after the after-dryer, and reeling the web into a machine reel.

31. A method for drying a paper web after a press section of a paper machine, comprising the steps of:

passing the web from the press section into a forward dryer section including only normal single-wire draw dryer groups, each of said normal dryer groups including drying cylinders arranged in a first row, reversing cylinders arranged in a second row below said first row, and a drying wire for carrying the web over said drying cylinders and said reversing cylinders, drying the web in the forward dryer section by passing the web through said normal dryer groups such that a bottom face of the web contacts said drying cylinders, passing the web from the forward dryer section into a finishing section, coating/surface-sizing the web in the finishing section by means of a coating/surface-sizing device, drying the web in an after-dryer arranged in the finishing section after the coating/surface-sizing device and including at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, calendering the web in a calender arranged after the after-dryer, measuring the curl of the web after the calender, controlling curling of the web in at least one of the forward dryer section and the finishing section based on the measured curl of the web after the calender, and reeling the web into a machine reel.

32. A dry end of a paper machine, comprising a forward dryer section including at least one dryer group, each of said at least one dryer group comprising drying cylinders, reversing cylinders and at least one drying wire for guiding a web over said drying cylinders and said reversing cylinders, a finishing section arranged after said forward dryer section, said finishing section including a coating/surface-sizing device for coating/surface-sizing the web, an after-dryer arranged after said coating/surface-sizing device for drying the web after the web is coated/surface-sized, a calender arranged after said after-dryer for calendering the web and a reeling station arranged after said calender for reeling the web into a machine reel, and curling control means arranged in or incorporated into at least one of said forward dryer section and said after-dryer for controlling the curling of the web, said curl control means comprising said after-dryer comprising two twin-wire draw dryer groups, each of said twin-wire draw dryer groups including first and second rows of drying cylinders, a first drying wire for carrying the web over said first row of drying cylinders such that the bottom face of the web contacts said drying cylinders in said first row and a second drying wire for carrying the web over said second row of drying cylinders such that a top face of the web contacts said drying cylinders in said upper row,.

33. A dry end of a paper machine, comprising a forward dryer section including at least one dryer group, each of said at least one dryer group comprising drying cylinders, reversing cylinders and at least one drying wire for guiding a web over said drying cylinders and said reversing cylinders, a finishing section arranged after said forward dryer section, said finishing section including a coating/surface-sizing device for coating/surface-sizing the web, an after-dryer arranged after said coating/surface-sizing device for drying the web after the web is coated/surface-sized, a calender arranged after said after-dryer for calendering the web and a reeling station arranged after said calender for reeling the web into a machine reel, said after-dryer comprising at least one dryer group including drying cylinders, reversing cylinders and a wire for guiding the web over said drying cylinders and said reversing cylinders, and curling control means arranged in or incorporated into said after-dryer for controlling the curling of the web, said curling control means comprising at least one hood arranged in connection with said at least one dryer group in said after-dryer, said at least one hood including means for blowing moist air toward the web.

34. A dry end of a paper machine, comprising a forward dryer section including at least one dryer group, each of said at least one dryer group comprising drying cylinders, reversing cylinders and at least one drying wire for guiding a web over said drying cylinders and said reversing cylinders, a finishing section arranged after said forward dryer section, said finishing section including a coating/surface-sizing device for coating/surface-sizing the web, an after-dryer arranged after said coating/surface-sizing device for drying the web after the web is coated/surface-sized, a calender arranged after said after-dryer for calendering the web and a reeling station arranged after said calender for reeling the web into a machine reel, measurement means arranged after said calender for measuring the curl of the web, and curling control means arranged in or incorporated into at least one of said forward dryer section and said after-dryer for controlling the curling of the web, said curling control means being controlled based on the measured curl of the web by said measurement means.

* * * * *